US011207904B2

(12) United States Patent
Koda et al.

(10) Patent No.: US 11,207,904 B2
(45) Date of Patent: Dec. 28, 2021

(54) PRINTING APPARATUS, CONTROL METHOD OF PRINTING APPARATUS, AND STORAGE MEDIUM

(71) Applicant: CANON KABUSHIKI KAISHA, Tokyo (JP)

(72) Inventors: Takeshi Koda, Yokohama (JP); Tomoyuki Nagase, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/831,855

(22) Filed: Mar. 27, 2020

(65) Prior Publication Data

US 2020/0307271 A1 Oct. 1, 2020

(30) Foreign Application Priority Data

Mar. 29, 2019 (JP) ..... JP2019-066225

(51) Int. Cl.

| | |
|---|---|
| ***B41J 11/68*** | (2006.01) |
| ***B41J 11/66*** | (2006.01) |
| *B41J 15/04* | (2006.01) |
| *B41J 11/42* | (2006.01) |

(52) U.S. Cl.

CPC ..... *B41J 11/68* (2013.01); *B41J 11/663* (2013.01); *B41J 11/42* (2013.01); *B41J 15/04* (2013.01)

(58) Field of Classification Search

CPC . B41J 11/68; B41J 11/663; B41J 15/04; B41J 11/42

See application file for complete search history.

(56) References Cited

U.S. PATENT DOCUMENTS

2005/0051011 A1* 3/2005 Onishi ..... B26D 11/00 83/428
2016/0101636 A1* 4/2016 Kanada ..... B41J 11/663 347/9
2018/0281218 A1* 10/2018 Urrutia Nebreda ..... B41J 11/66

FOREIGN PATENT DOCUMENTS

JP 2017-013438 A 1/2017

* cited by examiner

*Primary Examiner* — Yaovi M Ameh

(74) *Attorney, Agent, or Firm* — Venable LLP

(57) ABSTRACT

A printing apparatus includes: a conveyance unit; a print head; and a slitter disposed on a downstream relative to the print head and configured to cut the printing medium in a conveyance direction in accordance with the conveyance by the conveyance unit, wherein the slitter is configured to cut a leading edge portion of the printing medium in accordance with the conveyance of the printing medium, wherein, after the leading edge portion of the printing medium is cut by the slitter, the conveyance unit is configured to convey the printing medium in an opposite direction of the conveyance direction up to a printing start position, and wherein the print head is configured to start printing the image on the printing medium, which has been conveyed in the opposite direction of the conveyance direction up to the printing start position and of which the leading edge portion has been cut.

20 Claims, 15 Drawing Sheets

PRINTING APPARATUS, CONTROL METHOD OF PRINTING APPARATUS, AND STORAGE MEDIUM

BACKGROUND OF THE INVENTION

Field of the Invention

The present invention relates to a printing apparatus, a control method of a printing apparatus, and a storage medium.

Description of the Related Art

A printing apparatus provided with a printing unit for printing an image on a printing medium and a cutting unit for cutting the printing medium on which an image has been printed is known. Japanese Patent Laid-Open No. 2017-13438 (hereinafter referred to as Document 1) discloses a printed product discharge device provided with a slitter for cutting a long printing medium in parallel to the conveyance direction of the printing medium. The slitter disclosed in Document 1 is a pair of left and right slitters that are respectively movable in the width direction of the printing medium.

According to Document 1, a conveying portion conveys the printing medium so that the leading edge of the printing medium reaches the slitter. Further, both of the left and right ends of the printing medium are cut by the slitter in accordance with conveyance by the conveying portion.

As described in Document 1, in such a mode of cutting a printing medium in parallel to the conveyance direction by conveying the printing medium so that the printing medium enters a slitter, there is a possibility that the printing medium buckles at the timing of entering the slitter. Buckling causes various abnormalities such as deterioration in cutting accuracy, wrinkles and folds in the printing medium, and clogging with the printing medium.

SUMMARY OF THE INVENTION

An embodiment of the present invention includes: a conveyance unit configured to convey a printing medium in a conveyance direction; a print head configured to print an image on the printing medium conveyed by the conveyance unit; and a slitter disposed on a downstream relative to the print head in the conveyance direction and configured to cut the printing medium in the conveyance direction in accordance with the conveyance by the conveyance unit, wherein the slitter is configured to cut a leading edge portion of the printing medium in accordance with the conveyance of the printing medium by the conveyance unit, wherein, after the leading edge portion of the printing medium is cut by the slitter, the conveyance unit is configured to convey the printing medium in an opposite direction of the conveyance direction up to a printing start position, and wherein the print head is configured to start printing the image on the printing medium, which has been conveyed in the opposite direction of the conveyance direction up to the printing start position and of which the leading edge portion has been cut.

Further features of the present invention will become apparent from the following description of exemplary embodiments with reference to the attached drawings.

DESCRIPTION OF THE EMBODIMENTS

Hereinafter, an explanation is given of embodiments of the present invention with reference to the drawings. The following embodiments do not limit the present invention. Further, every combination of the characteristics explained in the present embodiments is not necessarily essential to the solution means of the present invention. The same reference sign is assigned for explanation of the identical configuration. In addition, relative positions, shapes, and the like, of the constituent elements described in the embodiments are merely examples and are not intended to limit the present invention to the range of the examples.

First Embodiment

Figure 1:
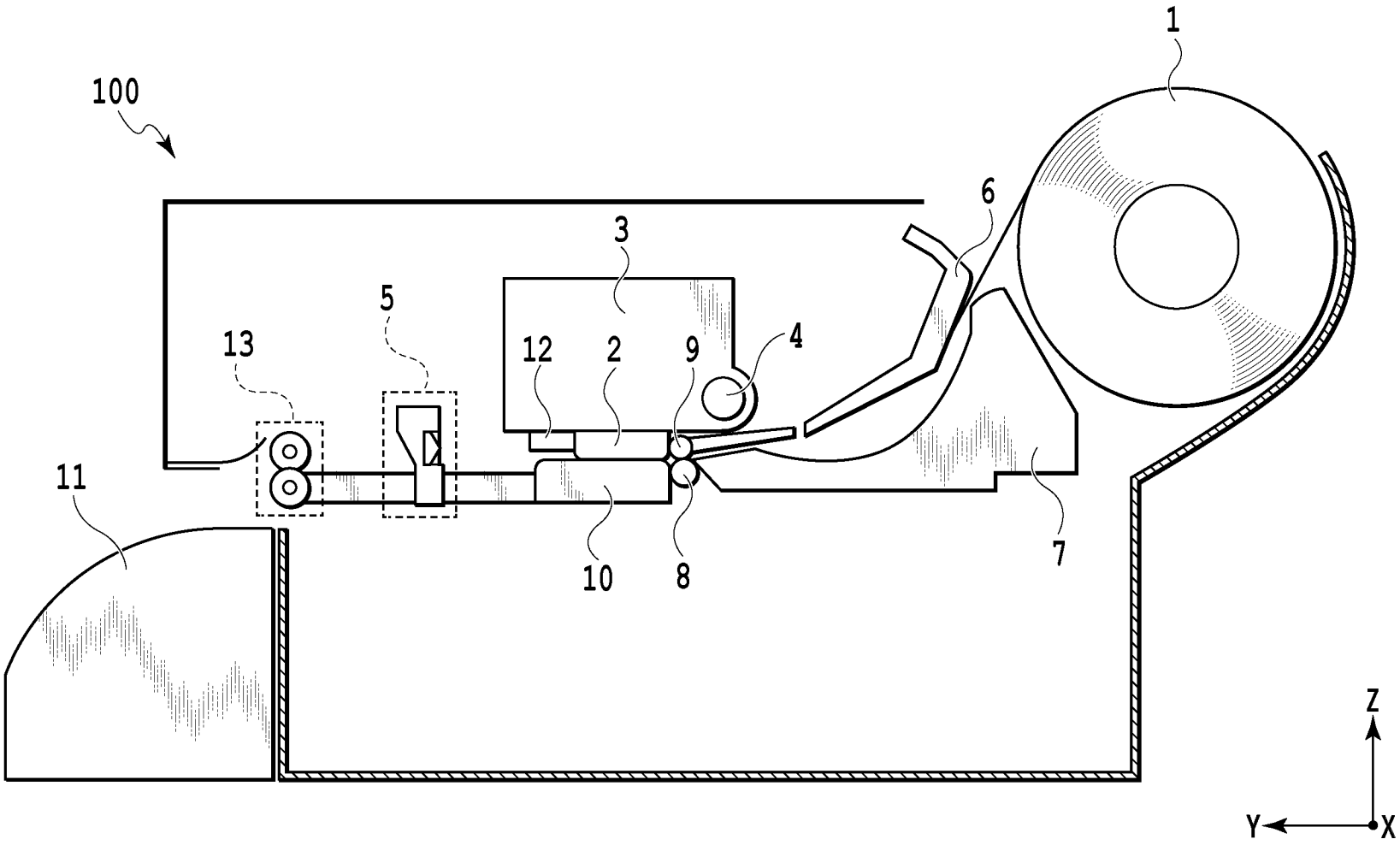
FIG. 1 is a cross-sectional view illustrating an example of a printing apparatus.

FIG. 1 is a cross-sectional view illustrating an example of an inkjet printing apparatus according to the present embodiment. The inkjet printing apparatus 100 (hereinafter simply referred to as the printing apparatus 100) performs printing on a printing medium that has a shape of a long sheet. In the present embodiment, the printing medium is a roll sheet 1. The roll sheet 1 held in the printing apparatus 100 is conveyed to the downstream side through a conveyance path formed by the upper guide 6 and the lower guide 7. The roll sheet 1 is nipped by the conveyance roller 8 and the pinch roller 9 and conveyed to an image printing unit. The image printing unit is configured to include the print head 2, the carriage 3 on which the print head 2 is mounted, and the platen 10 disposed at a position facing the print head 2. The roll sheet 1 is conveyed onto the platen 10 by the conveyance roller 8. Ink is ejected by the print head 2 onto the roll sheet 1 conveyed to the image printing unit, so as to print an image.

The carriage 3 is supported so as to be able to perform a sliding motion along the guide shaft 4 and a guide rail (not illustrated in the drawing) that are disposed in parallel to each other in the printing apparatus 100. The carriage 3 includes the reflection type detection sensor 12 facing the platen 10, so as to be able to detect the reflectivity of a spot position. That is, in a case where the platen 10 is black and the roll sheet 1 is white, the reflectivity of the platen 10 and the roll sheet 1 are greatly different. Therefore, it is possible to determine whether the platen 10 is present or the roll sheet 1 is present at the spot position by use of the detection sensor 12. It is possible to detect the leading edge of the roll sheet 1 by utilizing the fact that, while the roll sheet 1 is conveyed by the conveyance roller 8, the reflectivity greatly changes in a case where the leading edge of the roll sheet 1 in the conveyance direction passes through the spot position of the detection sensor 12.

The carriage 3 scans in the X direction along the guide shaft 4 while holding the print head 2, and the print head 2 ejects ink while the carriage 3 scans, so as to perform printing on the roll sheet 1. After a scan by the carriage 3 to perform printing on the roll sheet 1, the conveyance roller 8 conveys the roll sheet 1 by a predetermined amount, and the carriage 3 scans on the roll sheet 1 again to perform printing. In this way, by repeating printing and conveying, the entire printing is completed. Furthermore, since the detection sensor 12 is mounted on the carriage 3, the positions of the paper edges in the width direction (X direction) of the roll sheet 1 can also be detected by the reciprocating operation of the carriage 3. Instead of the above-described serial system, the printing system may be a full line system in which an image is printed while a roll sheet 1 is continuously conveyed, by use of a long print head that extends in the direction intersecting the conveyance direction of the roll sheet 1.

On the downstream side relative to the carriage 3 in the conveyance direction of the roll sheet 1, there is provided the cutter 5 for cutting the roll sheet 1 in a direction intersecting the conveyance direction, and, on the further downstream side, there is provided the slitter 13 for cutting the roll sheet 1 in the conveyance direction. On the downstream side relative to the slitter 13, there is provided the discharging guide 11 for discharging the roll sheet 1 that has been cut.

The cutter 5 includes a cutter unit 300 (see FIG. 2) as a cutting mechanism for cutting the roll sheet 1 and a unit for moving the cutter unit 300 along the X direction. Furthermore, the slitter 13 includes a slitter unit 303 (see FIG. 2) as a cutting mechanism for cutting the roll sheet 1 and a unit for moving the slitter unit 303 along the X direction.

Figure 2:
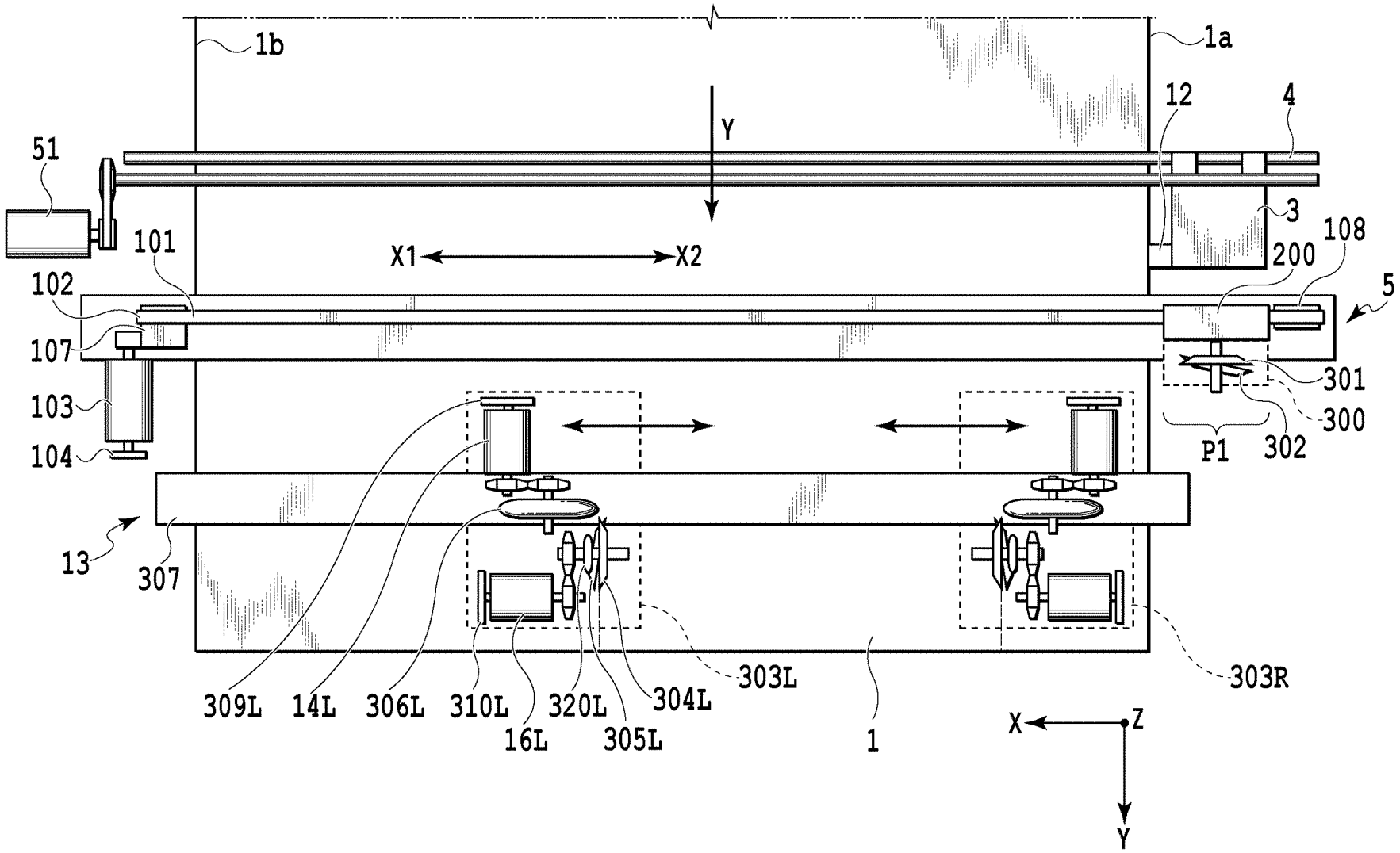
FIG. 2 is a top view of the printing apparatus.

FIG. 2 is a top view for explaining the cutter 5 and the slitter 13 including the slitter units 303L and 303R. In the present specification, "L" and "R" at the end of the reference signs indicate a member on the left side (that is, +X side) and a member on the right side (that is, −X side) on the drawings, respectively. In the present specification, such an end of a reference sign may be omitted in a case of members that are the same on the left side and the right side.

The guide rail 101 is configured to guide the cutter carriage 200 in the direction intersecting the conveyance direction of the roll sheet 1. The cutter carriage 200 integrally connects the cutter unit 300 and the belt 102. Furthermore, the belt 102 is configured to bridge the motor pulley 107 and the tensioner pulley 108 disposed on the left and right sides of the guide rail 101 and is configured to be moved by the cutter motor 103 connected to the motor pulley 107. The cutter motor 103 is provided with the cutter encoder 104. The cutter encoder 104 counts the number of pulses corresponding to driving of the cutter motor 103. Based on the origin position of the cutter carriage 200 and the number of pulses obtained by the cutter encoder 104, it is possible to control the movement position of the cutter unit 300 in the X1 and X2 directions.

The cutter unit 300 includes the upper movable blade 301 and the lower movable blade 302, so that the roll sheet 1 is cut at the contact point of the upper movable blade 301 and the lower movable blade 302 while the cutter unit 300 moves in the X1 direction. Furthermore, the upper movable blade 301 and the lower movable blade 302 are connected to the cutter motor 103 via the belt 102 and the cutter carriage 200 and are configured to be rotationally driven. In a case where the roll sheet 1 is cut, the roll sheet 1 is cut while the lower movable blade 302 and the upper movable blade 301, which is in contact with the lower movable blade 302, rotate together. In the example of FIG. 2, the cutter unit 300 performs cutting from the first end 1*a* of the roll sheet 1 to the second end 1*b* of the roll sheet 1. The first end 1*a* of the roll sheet 1 is an end on the stand-by position P1 side of the cutter unit 300. After the roll sheet 1 is cut, the cutter carriage 200 is reversed at a predetermined reversing position. Further, the cutter carriage 200 moves to a position that is the stand-by position P1 to stand by for the next cutting operation. Although the cutter unit 300 is mounted on the cutter carriage 200 in the example of the present embodiment, the cutter unit 300 may be mounted on the carriage 3 that moves the print head 2, etc., for example.

The slitter 13 is disposed on the downstream side relative to the cutter 5 in the conveyance direction of the roll sheet 1. The slitter 13 is able to move a slitter unit 303 to a given position in the X1 and X2 directions and is able to cut the roll sheet 1 in the direction parallel to the conveyance direction (+Y direction) by use of the slitter unit 303. In the present embodiment, an explanation is given of a configuration in which two slitter units 303 are mounted. That is, an explanation is given of the example in which the slitter units 303L and 303R are mounted. The slitter units 303L and 303R have the same configuration with the components that are left-right reversals in the X1 and X2 directions. In FIG. 2, for the sake of simplification, reference signs are mainly assigned to the components of the slitter unit 303L.

Figure 3A:
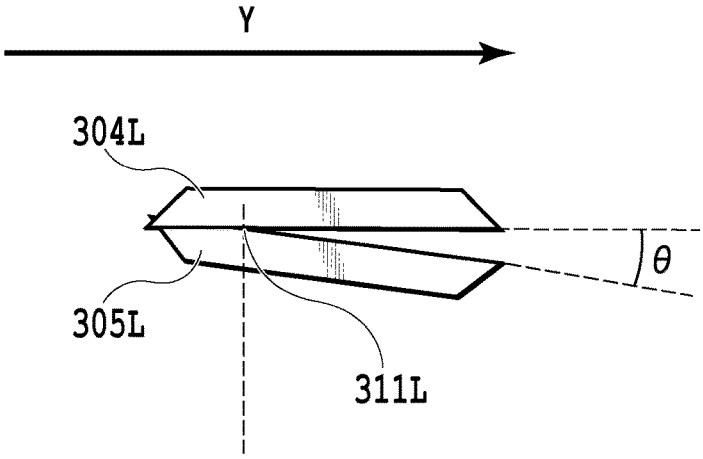
FIGS. 3A and 3B are diagrams for explaining movable blades of a slitter.
Figure 3B:
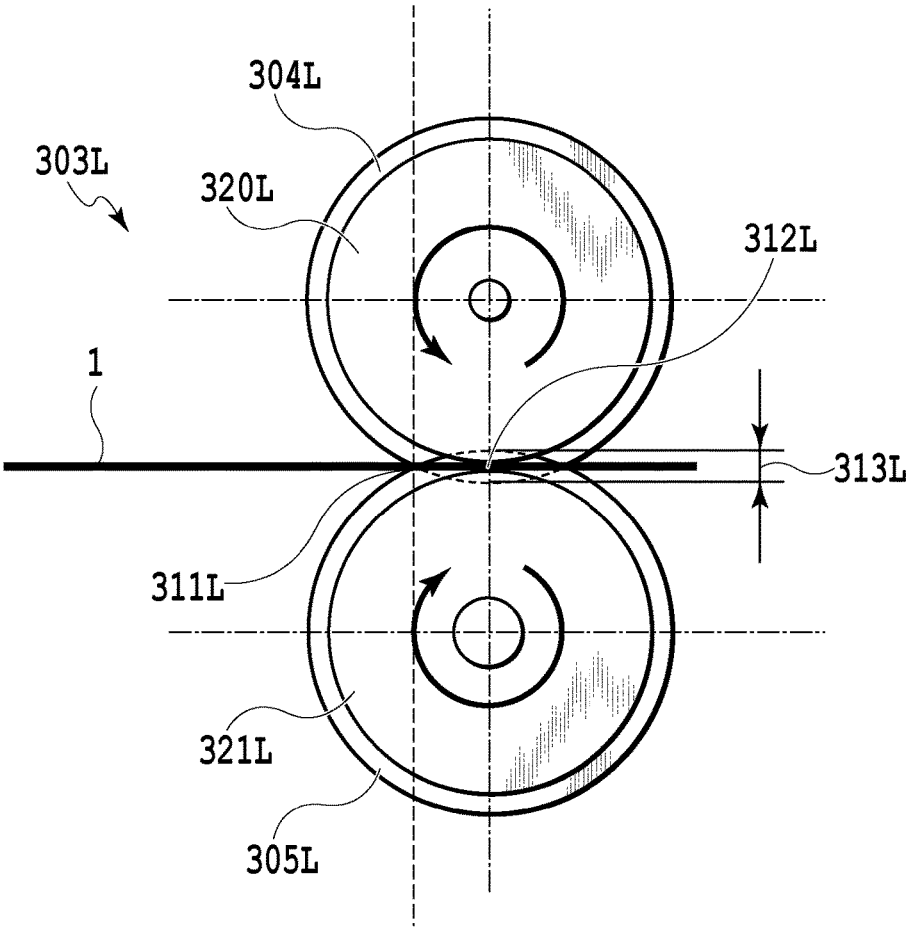
Figure 4:
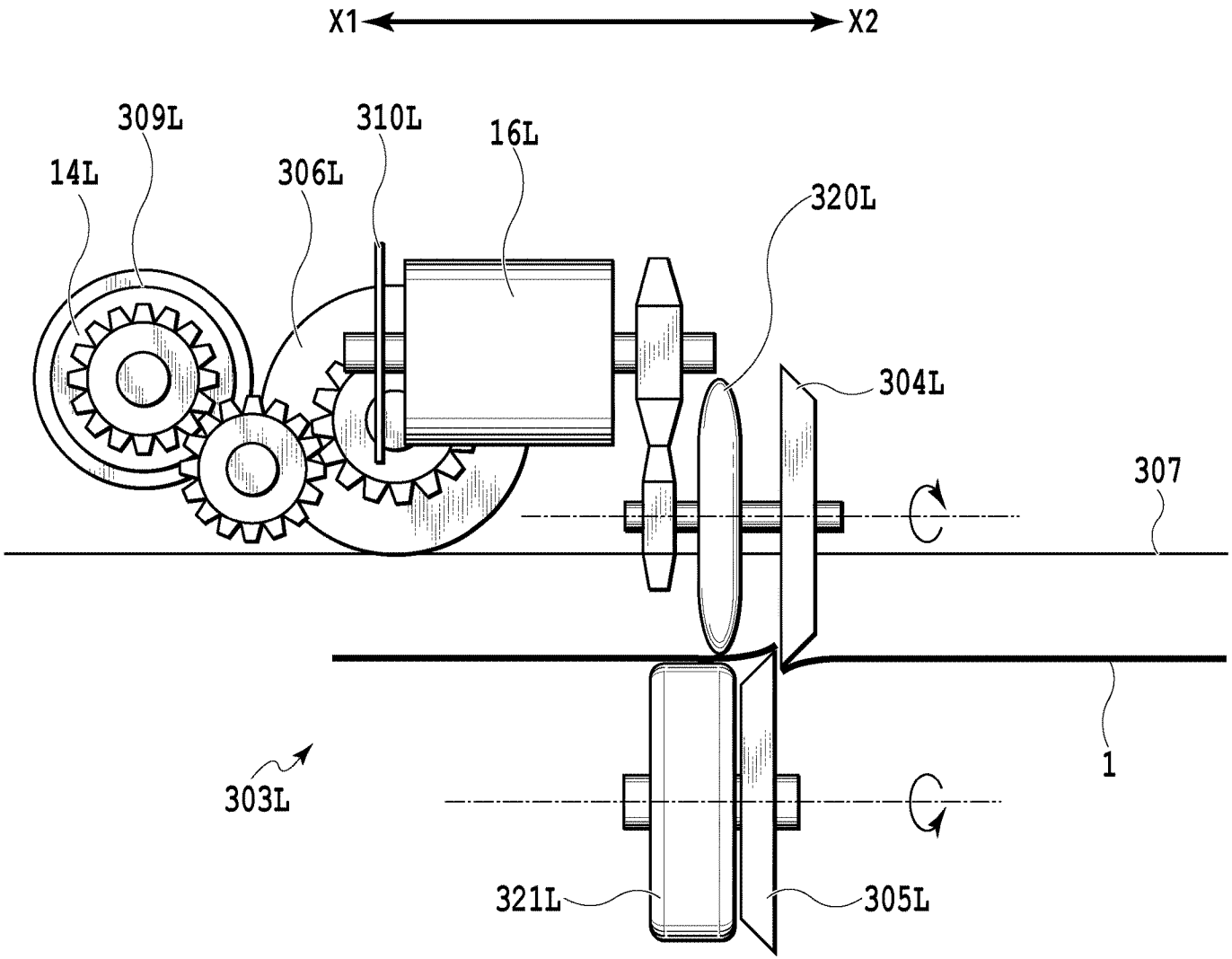
FIG. 4 is an enlarged view of a configuration in the vicinity of the slitter.

FIGS. 3A and 3B and FIG. 4 are diagrams for explaining details of the slitter unit 303L. FIG. 3A is a schematic top view of the slitter unit 303L, and FIG. 3B is a schematic side view of the slitter unit 303L. The slitter unit 303L includes the slitter upper movable blade 304L and the slitter lower movable blade 305L. The slitter upper movable blade 304L and the slitter lower movable blade 305L are disposed so as to have a round blades overlap amount 313L in the vertical direction and have a predetermined amount of angle (intersect angle) θ relative to the conveyance direction Y, which is the cutting direction. The roll sheet 1 is cut at the contact point 311L of the slitter upper movable blade 304L and the slitter lower movable blade 305L. The slitter upper movable blade 304L is connected to the slitter driving motor 16L via a gear.

In a case where the slitter upper movable blade 304L is rotated by the driving force of the slitter driving motor 16L, the slitter upper conveyance roller 320L, which is connected coaxially with the slitter upper movable blade 304L, rotates as well. The outer diameter of the slitter upper conveyance roller 320L is in contact with the outer diameter of the slitter lower conveyance roller 321L, which is connected coaxially with the slitter lower movable blade 305L, at the roller nip point 312L. Thus, by driving with friction transmission, while the roll sheet 1 is conveyed by the slitter upper conveyance roller 320L and the slitter lower conveyance roller 321L, the upper and lower blades rotate together to cut the roll sheet 1 in the conveyance direction. Since the slitter driving motor 16L is provided with the slitter driving encoder 310L, it is possible to control the slitter driving motor 16L with a predetermined rotation speed and a predetermined rotation amount. The slitter driving motor 16L is controlled to drive at a driving amount (specifically, a rotation speed and a rotation amount), which is synchronized with and corresponding to the conveyance amount by the conveyance roller 8.

The slitter unit 303L includes the slitter moving motor 14L and is configured such that driving force is transmitted to the slitter moving roller 306L via a gear. The slitter moving roller 306L abuts on the slitter guide rail 307, and the slitter unit 303L is configured to be movable in the X1 and X2 directions by friction between the front surface of the slitter moving roller 306L and the slitter guide rail 307. In other words, the slitter upper movable blade 304L, the slitter lower movable blade 305L, the slitter upper conveyance roller 320L, and the slitter lower conveyance roller 321L are integrally movable along the slitter guide rail 307.

Although the slitter moving roller 306L is driven with friction in the present embodiment, the slitter moving roller 306L may have a rack and pinion configuration with a slitter moving roller serving as a pinion and a slitter guide rail serving as a rack.

Next, an explanation is given of general operation of cutting by the slitter 13. First, the slitter units 303L and 303R are moved to cutting positions, and the roll sheet 1 is conveyed by the conveyance roller 8 while the conveyance motor 51 and the slitter driving motors 16L and 16R are driven at the same speed. In a case where the leading edge of the roll sheet 1 reaches the contact points 311L and 311R of the slitter 13, the roll sheet 1 is cut by the slitter upper movable blades 304L and 304R and the slitter lower movable blades 305L and 305R on the left and right sides. Furthermore, the roll sheet 1 is nipped and conveyed by the slitter upper conveyance rollers 320L and 320R and the slitter lower conveyance rollers 321L and 321R on the left and right sides while being cut, so as to be discharged through the discharging guide 11.

Additionally, cutting by the slitter 13 can be performed together with image printing. The slitter units 303 move from the stand-by positions to predetermined cutting positions in the X1 and X2 directions according to the setting by the user. Then, the roll sheet 1 is conveyed by the conveyance roller 8 while the conveyance motor 51 and the slitter driving motors 16L and 16R are driven at the same speed. In the image printing unit, in response to forward or return scanning of one line by the carriage 3 for printing an image, the roll sheet 1 is conveyed by the conveyance roller 8 and the pinch roller 9 by a predetermined pitch. Then, the carriage 3 is moved again to perform image printing of the next line. In a case where printing proceeds and the leading edge of the roll sheet 1 reaches the contact points 311, the roll sheet 1 is cut by the slitter upper movable blades 304L and 304R and the slitter lower movable blades 305L and 305R that are rotating. Furthermore, the roll sheet 1 is nipped and conveyed by the slitter upper conveyance rollers 320L and 320R and the slitter lower conveyance rollers 321L and 321R while being cut. Then, the image printing ends and the cutting by the slitter units 303 ends. Subsequently, the slitter units 303 move to the predetermined stand-by positions. The roll sheet 1 is conveyed to the cutting position where the cutter 5 can cut the roll sheet 1 and is cut by the cutter 5, so as to be discharged through the discharging guide 11.

The configuration of the slitter 13 described above is merely an example. That is, the slitter 13 may have any configuration as long as the slitter 13 is movable in the width direction of the roll sheet 1 and is able to cut the conveyed roll sheet 1 in the conveyance direction at a given position of the width direction. Further, there may be a mode in which the slitter upper conveyance rollers 320 and the slitter lower conveyance rollers 321, the slitter upper movable blades 304, and the slitter lower movable blades 305 are independently driven.

Figure 5:
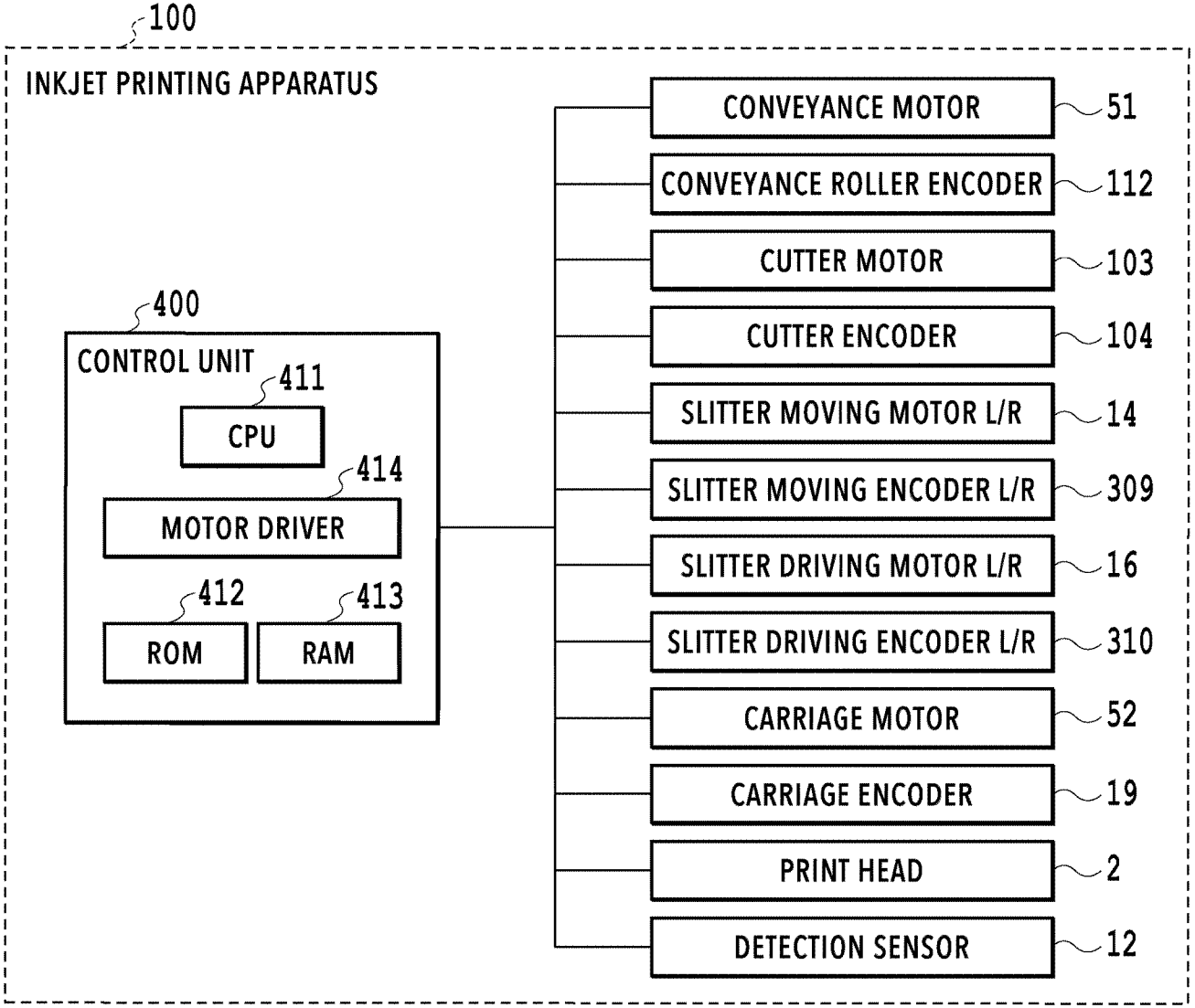
FIG. 5 is a schematic block diagram illustrating a control configuration of the printing apparatus.

FIG. 5 is a schematic block diagram illustrating a control configuration of the printing apparatus 100. The printing apparatus 100 includes a control unit 400. Furthermore, the control unit 400 includes a CPU 411, a ROM 412, a RAM 413, and a motor driver 414. The control unit 400 implements control of a conveyance motor 51, a cutter motor 103, a slitter moving motor 14, a slitter driving motor 16, a carriage motor 52, and a print head 2. The control unit 400 obtains signals from a conveyance roller encoder 112, a cutter encoder 104, a slitter moving encoder 309, a slitter driving encoder 310, a carriage encoder 19, and a detection sensor 12. Furthermore, the control unit 400 controls the various motors and the print head 2, based on the signals.

<Cutting Operation and Printing Operation of the Comparative Example in which Sheet Jamming Occurs>

Next, an explanation is given of the operation of the comparative example in which sheet jamming easily occurs. After that, the operation of the present embodiment is explained.

As described above, in the printing apparatus 100, the cutter 5 is disposed on the downstream side relative to the print head in the conveyance direction of the roll sheet 1. The cutter 5 is disposed on the upstream side relative to the slitter 13. In such an arrangement configuration, after completion of image printing and cutting by the slitter 13, the roll sheet 1 is cut by the cutter 5 in an intersecting direction, which intersects the conveyance direction.

That is, the operation of the comparative example is schematically explained as follows.

(S1) An image is printed at the leading edge of the roll sheet 1 in the conveyance direction.

(S2) The leading edge of the roll sheet 1, on which the image has been printed, is cut by the slitter 13.

(S3) The printing of the image and the cutting by the slitter 13 are performed concurrently with each other.

(S4) The printing is completed up to the rear edge position of the image.

(S5) The cutting by the slitter 13 is completed up to the position to be cut, which is the rear edge of the printed subject.

(S6) The roll sheet 1, on which the printing and the cutting in the conveyance direction have been completed, is reversely conveyed so that the position to be cut, which is on the roll sheet 1, matches the cutting position of the cutter 5.

(S7) Cutting in the intersecting direction is performed by the cutter 5.

Here, at the timing where the leading edge of the roll sheet 1 enters the slitter units 303 of the slitter 13 in (S2) as described above, there is a possibility that the leading edge of the roll sheet 1 is not properly fed into the slitter upper movable blades 304 and the slitter lower movable blades 305. For this reason, sheet jamming easily occurs because of buckling of the roll sheet 1.

<Cutting Operation and Printing Operation of the Present Embodiment>

According to the control performed in the present embodiment, predetermined operation is performed prior to the operation of (S1), and operation that is partially different from the operation of (S2) is performed, as compared to the above-described comparative example. Specifically, the following operation is performed prior to the operation of (S1).

(SA) Predetermined portions of the leading edge of the roll sheet 1 are cut by the slitter 13 in a state where there is not an image printed on the roll sheet 1.

(SB) The roll sheet 1, of which the predetermined portions of the leading edge have been cut, is reversely conveyed up to the printing start position of the image.

Furthermore, the operation of (S2) is replaced with the following operation of (S2)'.

(S2)' The portions extending from the predetermined portions of the leading edge of the roll sheet 1, on which the image has been printed, are cut by the slitter 13.

That is, in the present embodiment, the operation of making a cut by a slitter unit 303 of the slitter 13 is performed at a leading edge portion of the roll sheet 1 in the conveyance direction. Thereafter, the roll sheet 1 is rewound, and the printing operation of an image and the cutting operation by the slitter 13 are performed. Since the cuts have already been made, the leading edge of the roll sheet 1 smoothly enters the slitter units 303 at the timing where the leading edge re-enters the slitter units 303. That is, at the timing where the leading edge of the roll sheet 1 re-enters the slitter units 303, the leading edge portions of the roll sheet 1 are properly fed into the slitter upper movable blades 304 and the slitter lower movable blades 305 of the slitter units 303. For this reason, it is possible to prevent the roll sheet 1 from buckling at a timing where the roll sheet 1 enters a slitter unit 303. In the following, the explanation is given with reference to the flowchart and the conceptual diagrams of the operation.

<Flowchart>

Figure 6:
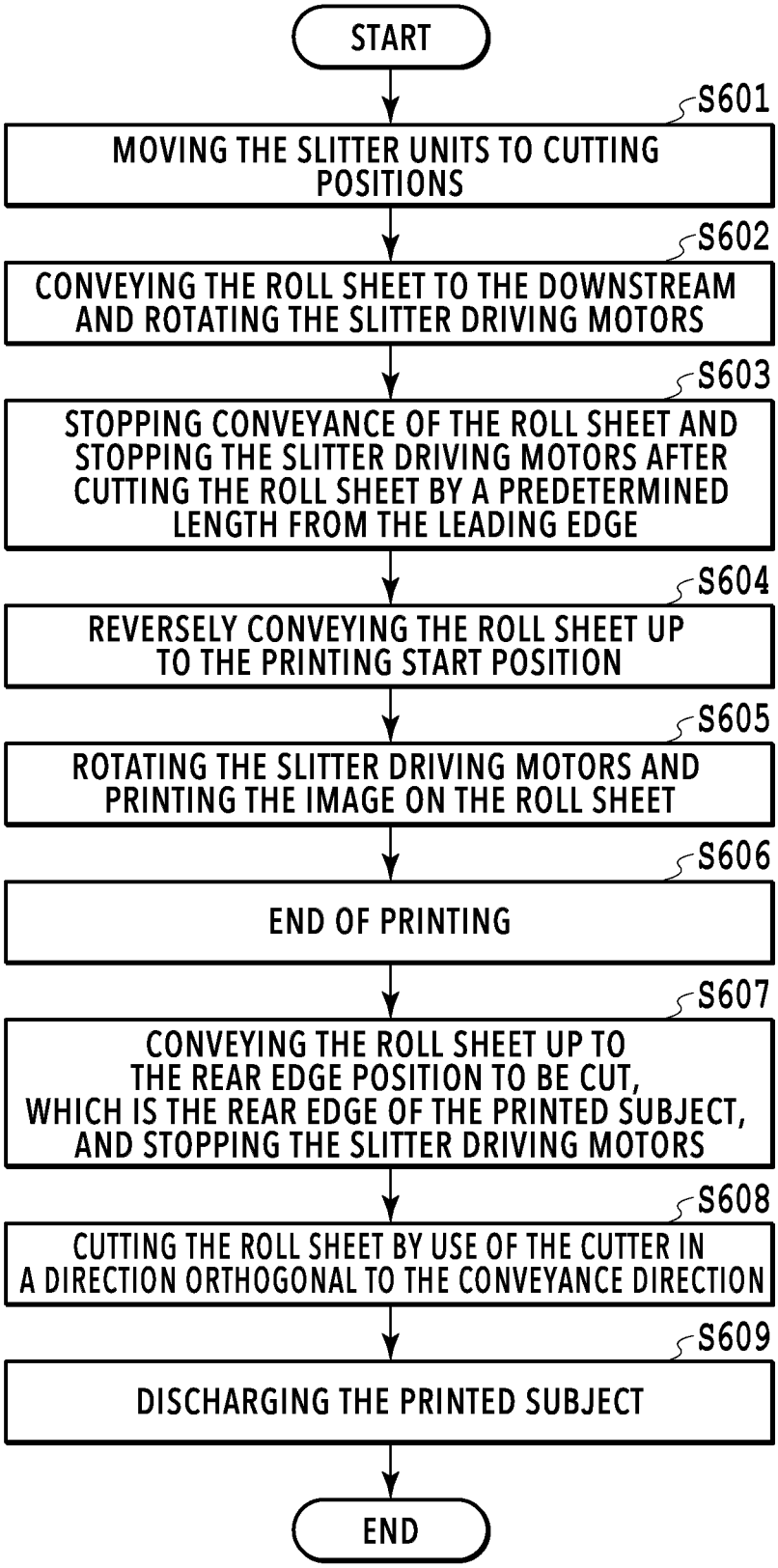
FIG. 6 is a flowchart illustrating a procedure of cutting operation and image printing operation.

FIG. 6 is a flowchart illustrating the procedure of the cutting operation and the image printing operation in the present embodiment. FIGS. 7 through 15 are conceptual diagrams of the operation according to the flowchart of FIG. 6. Hereinafter, an explanation is given with reference to FIGS. 6 through 15. The processing of FIG. 6 is performed by the CPU 411 of the control unit 400 in the printing apparatus 100 retrieving a program code stored in the ROM 412 into the RAM 413 and executing the program code. Alternatively, a part or all of the steps in FIG. 6 may be implemented by hardware such as an ASIC or an electronic circuit. The symbol "S" in the explanation of each process means that it is a step in the flowchart. The processing illustrated in FIG. 6 is started in response to a print job, which is received by the printing apparatus 100.

In S601, the control unit 400 moves the slitter units 303R and 303L to cutting positions in the intersecting direction, which intersects the conveyance direction, in accordance with the sheet width size of the printed subject based on the print job. That is, the control unit 400 drives the slitter moving motors 14 until the slitter units 303R and 303L move along the slitter guide rail 307 to the cutting positions in the intersecting direction.

In S602, the control unit 400 drives the slitter driving motors 16 while driving the conveyance motor 51 to convey the roll sheet 1 to the downstream side in the conveyance direction. In this state, in a case where the leading edge of the roll sheet 1 in the conveyance direction is conveyed up to the positions of the slitter units 303R and 303L, cutting by the slitter units 303R and 303L is started from the leading edge of the roll sheet 1.

In S603, the control unit 400 cuts the roll sheet 1 in the conveyance direction from the leading edge of the roll sheet 1 by a predetermined length, then the control unit 400 stops conveying the roll sheet 1 and ends the cutting by the slitter 13. That is, the control unit 400 performs cutting by the slitter units 303R and 303L by controlling the conveyance roller 8 and the pinch roller 9 to convey the roll sheet 1 until the cutting by the slitter units 303R and 303L reaches the positions corresponding to the predetermined length from the leading edge of the roll sheet 1. Then, the control unit 400 stops the conveyance motor 51 and the slitter driving motors 16 at the timing where the roll sheet 1 is cut by the predetermined length from the leading edge. Although the roll sheet 1 is conveyed also by the slitter upper conveyance rollers 320 and the slitter lower conveyance rollers 321 as described above, a description of the conveyance by the slitter upper conveyance rollers 320 and the slitter lower conveyance rollers 321 is omitted for the sake of simplicity of explanation.

Figure 7:
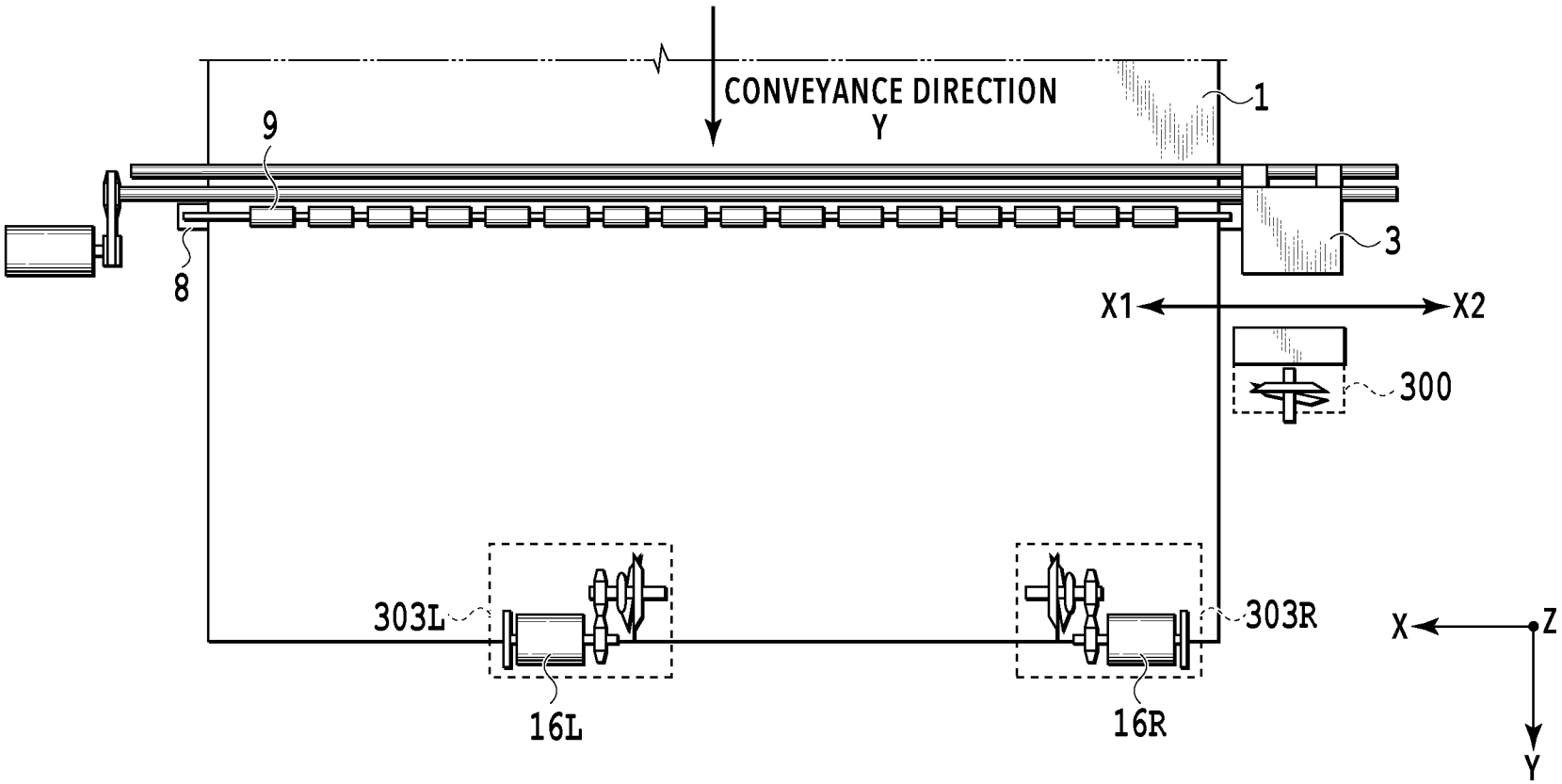
FIG. 7 is a conceptual diagram of operation of the printing apparatus.

FIG. 7 is a diagram illustrating a situation in which the leading edge portions of the roll sheet 1 are being cut by the slitter units 303R and 303L in the direction parallel to the conveyance direction. In the present embodiment, firstly, the leading edge portions (the portions with a predetermined length from the leading edge) of the roll sheet 1 are cut in the direction parallel to the conveyance direction by the slitter units 303R and 303L, instead of immediately starting the printing operation in response to the reception of the print job.

Figure 8:
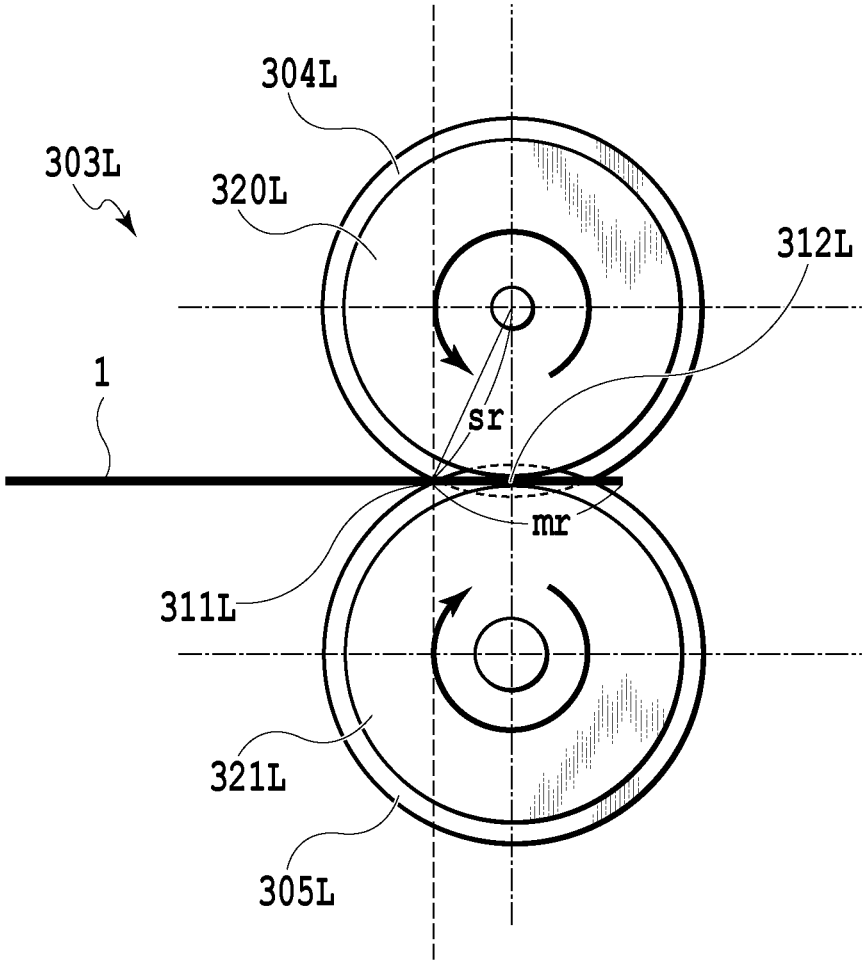
FIG. 8 is a schematic side view of the slitter.

FIG. 8 is a schematic side view of the slitter unit 303L. An explanation is given of the predetermined length with reference to FIG. 8. As explained in FIG. 3, the slitter unit 303L includes the slitter upper movable blade 304L and the slitter lower movable blade 305L that can be rotated by the slitter driving motor 16L. That is, a slitter unit 303 includes a round blade. As illustrated in FIG. 8, in the present embodiment, the predetermined length mr from the leading edge of the roll sheet 1 in the conveyance direction corresponds to the radius sr of the slitter upper movable blade 304L or the slitter lower movable blade 305L. In a case where a cut is made from the leading edge by approximately the same length as the radius sr of the slitter upper movable blade 304L or the slitter lower movable blade 305L, the leading edge of the roll sheet 1 is properly fed into the slitter unit 303 at a timing where the roll sheet 1 re-enters the slitter unit 303, as described later. The radius of the round blade is, for example, 6 to 20 mm. Here, it is assumed that the radius of the round blade is 10 mm.

Although it is assumed that the slitter upper movable blade 304L and the slitter lower movable blade 305L have the same radius in the explanation of the present embodiment, the radius of the slitter upper movable blade 304L and the radius of the slitter lower movable blade 305L may be different. In a case where the radius of the slitter upper movable blade 304L and the radius of the slitter lower movable blade 305L are different, the predetermined length may be the length corresponding to the round blade having the larger radius.

In S604, the control unit 400 reversely drives the conveyance motor 51 to rotate the conveyance roller 8 in the opposite direction, so as to convey the roll sheet 1 in the opposite direction (−Y direction) of the conveyance direction (hereinafter referred to as reverse conveyance). The control unit 400 reversely conveys the roll sheet 1 up to the position where the printing based on the print data is started (hereinafter, referred to as the printing start position). The control unit 400 reversely conveys the roll sheet 1 up to the printing start position and then stops the conveyance motor 51.

Figure 9:
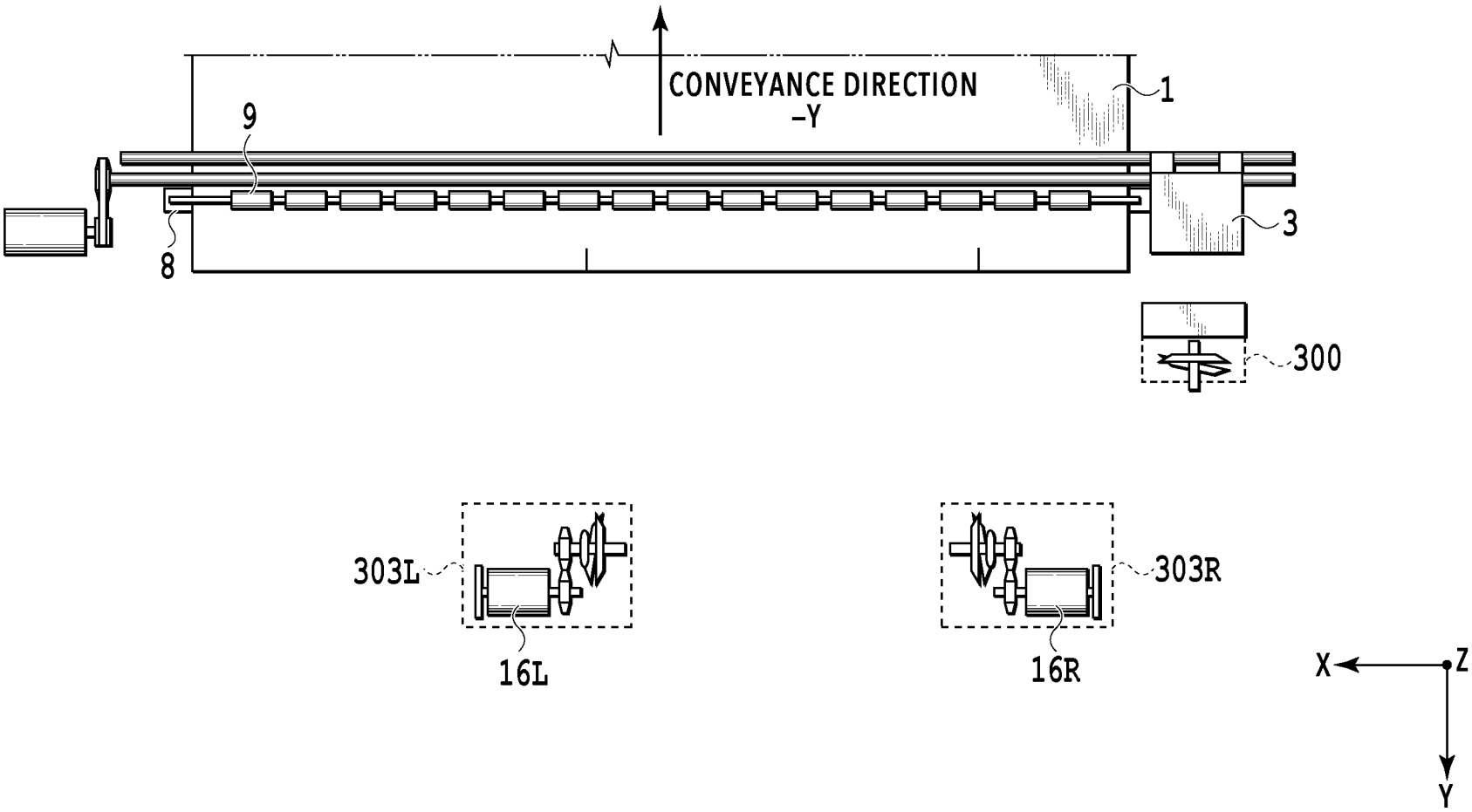
FIG. 9 is a conceptual diagram of operation of the printing apparatus.

FIG. 9 is a diagram illustrating a state in which the roll sheet 1 has been reversely conveyed up to the printing start position. Cuts are made at the leading edge portions of the roll sheet 1.

In S605, the control unit 400 rotates the slitter driving motors 16 and prints the image on the roll sheet 1. In other words, the control unit 400 performs printing of the image by use of the print head 2 while driving the conveyance motor 51 to convey the roll sheet 1. That is, conveyance of the roll sheet 1 and printing of the image are performed alternately. In addition, by rotating the slitter driving motors 16, the cutting of the roll sheet 1 in the conveyance direction is prepared.

Figure 10:
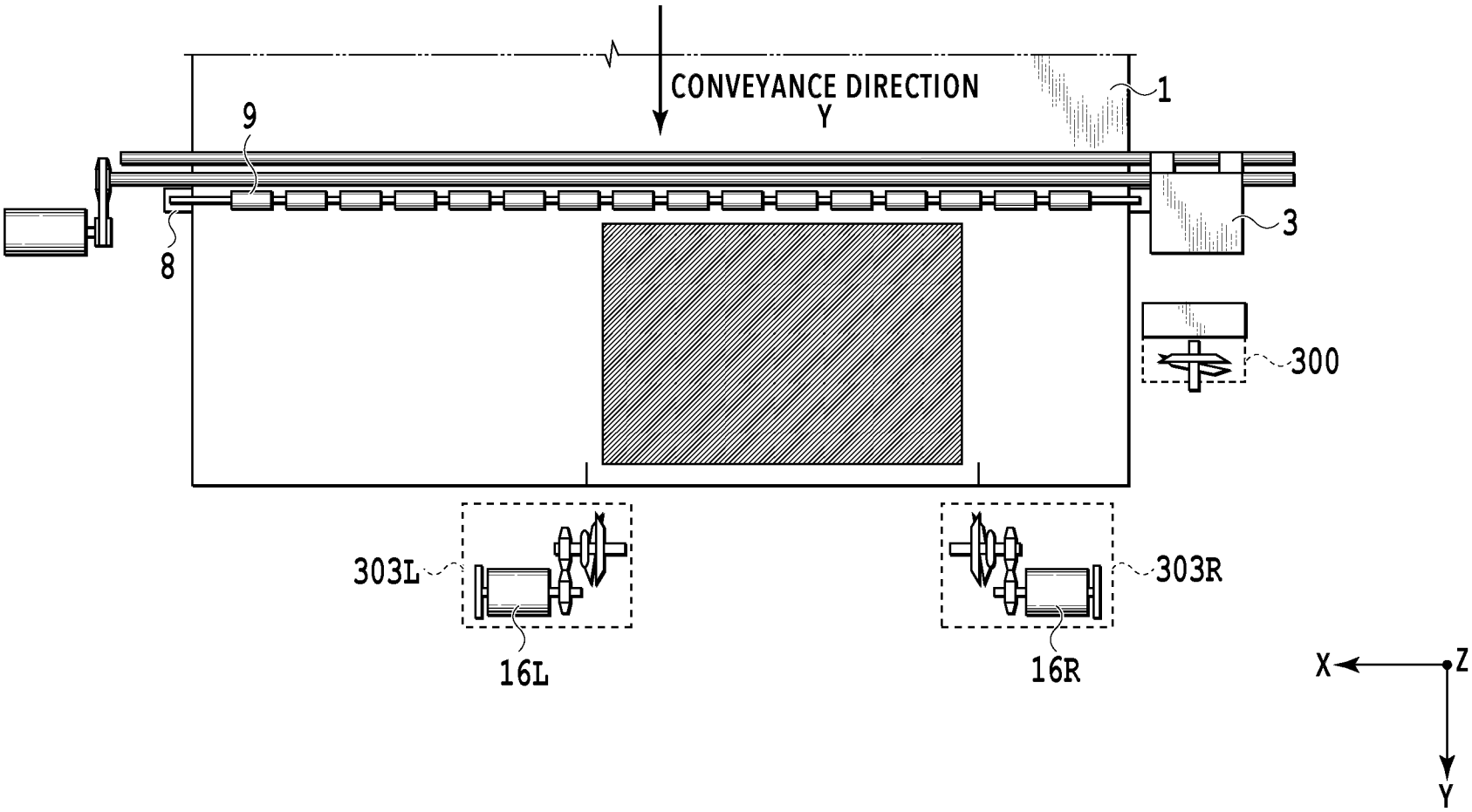
FIG. 10 is a conceptual diagram of operation of the printing apparatus.

FIG. 10 is a diagram illustrating a state before the leading edge portions of the re-conveyed roll sheet 1 enters the slitter units 303. An image is printed on the roll sheet 1, on which cuts have been made at the leading edge portions. In a case where the printing of the image and the conveyance of the roll sheet 1 are continuously repeated in this state, the contact points 311 of the slitter units 303 reach the cut portions of the roll sheet 1. Since the cuts have already been made, the leading edge portions of the roll sheet 1 and the portions extending immediately from the leading edge portions are properly fed into the slitter upper movable blades 304 and the slitter lower movable blades 305 of the slitter units 303. Thereafter, conveyance of the roll sheet 1, printing of the image, and cutting of the portions extending from the leading edge portions by the slitter units 303 are repeated.

Figure 11:
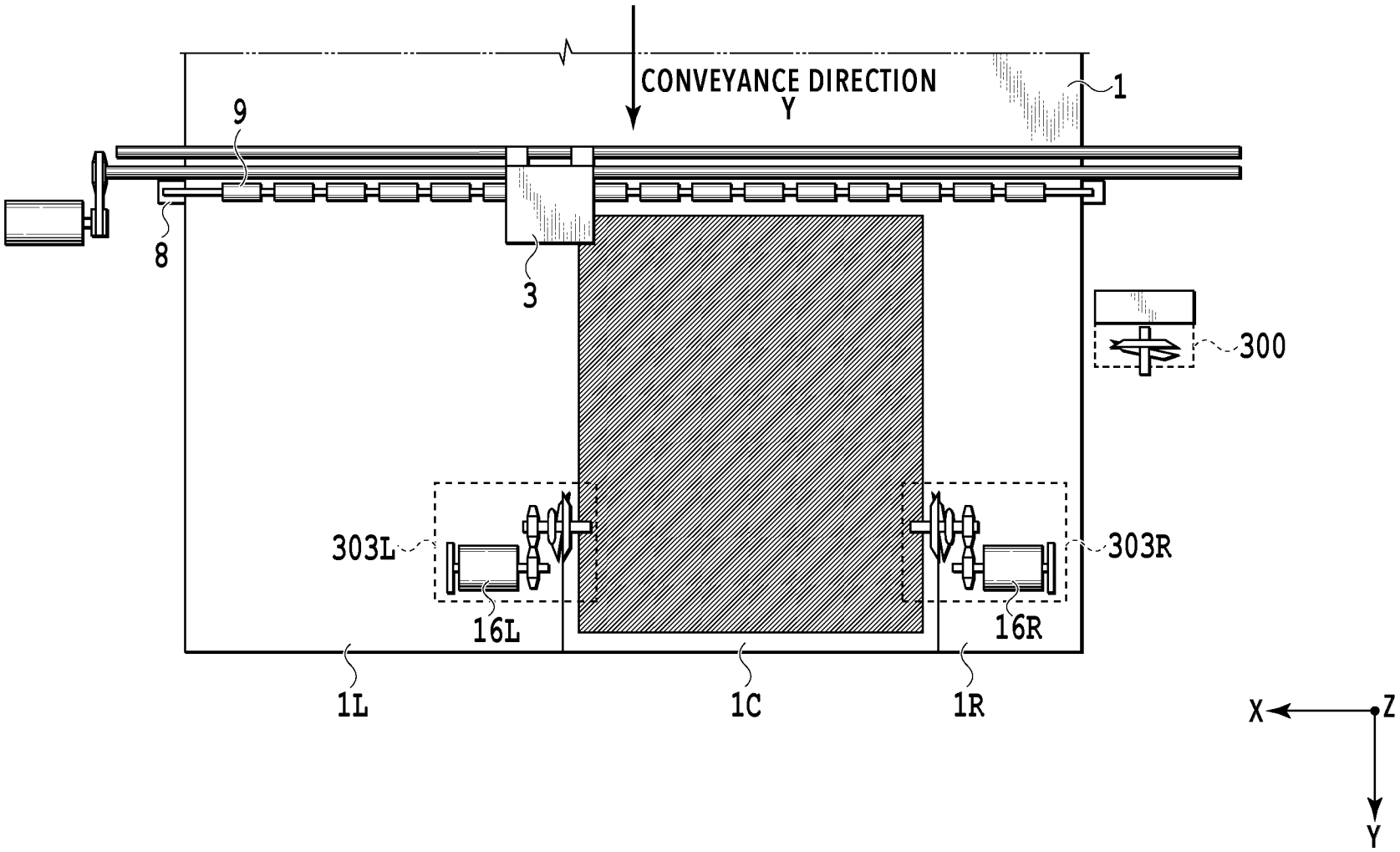
FIG. 11 is a conceptual diagram of operation of the printing apparatus.

In S606, the control unit 400 completes the printing operation up to the printing position corresponding to the rear edge in the conveyance direction. FIG. 11 is a diagram illustrating a state in which printing of an image by use of the print head 2 has been completed. Since the print head 2 is disposed on the upstream side relative to the slitter 13 in the conveyance direction, the cutting of the roll sheet 1 by the slitter 13 up to the rear edge position to be cut has not been done at the timing where the printing of the image ends. Therefore, the roll sheet 1 is continuously conveyed and cut by the slitter 13.

In S607, the control unit 400 conveys the roll sheet 1 up to the rear edge position to be cut, which corresponds to the rear edge of the printed subject, then the control unit 400 stops the slitter driving motors 16 upon reaching the rear edge position to be cut.

Figure 12:
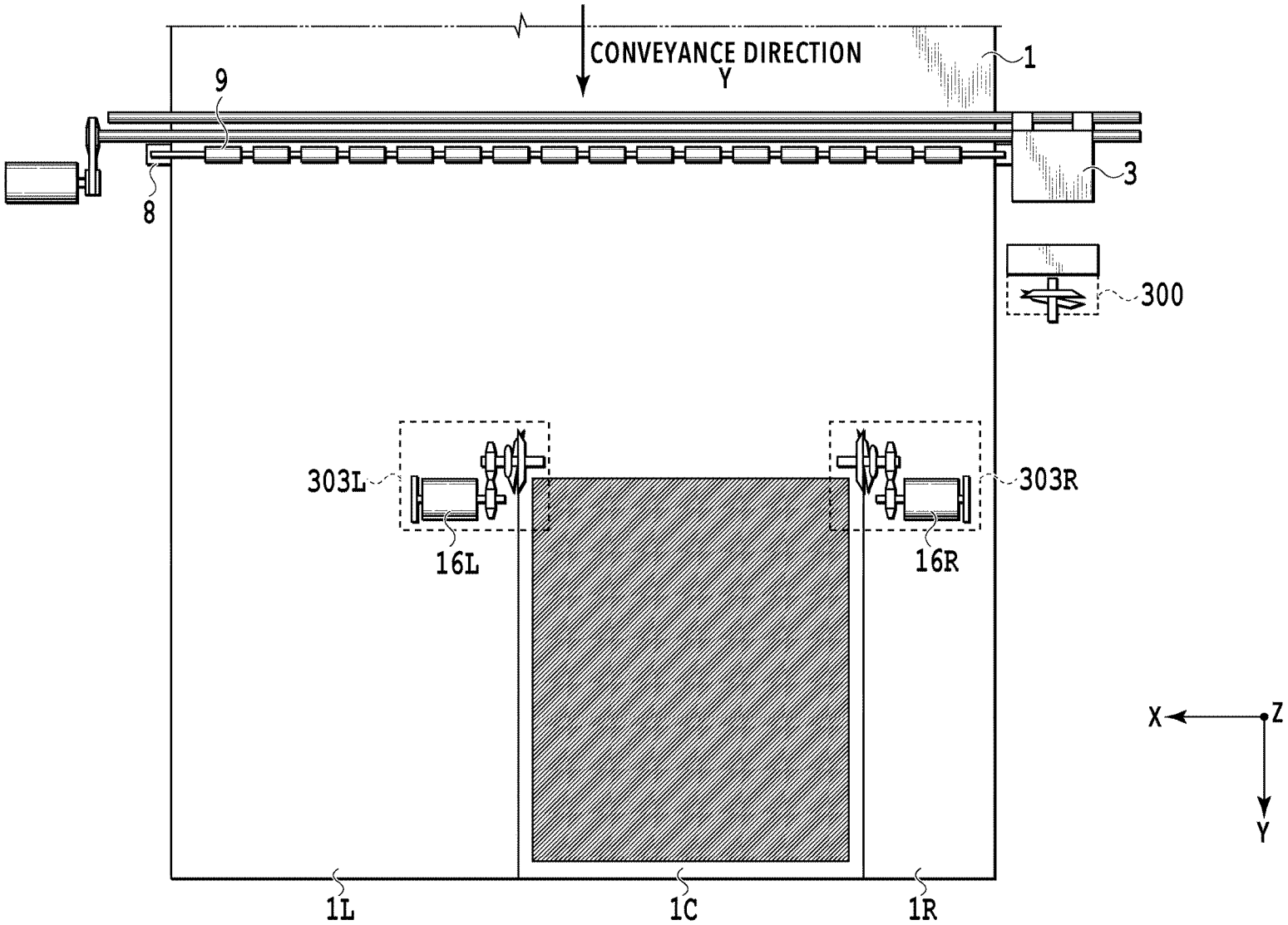
FIG. 12 is a conceptual diagram of operation of the printing apparatus.

FIG. 12 illustrates a state in which the roll sheet 1 has been further conveyed from the state of FIG. 11 up to such a position that the rear edge position to be cut, which corresponds to the printed subject 1C, has been cut by the slitter units 303. As illustrated in FIG. 12, in the present embodiment, the cutter 5 is disposed on the downstream side relative to the print head 2 in the conveyance direction, and the slitter 13 is disposed on the downstream side relative to the cutter 5. Therefore, since the roll sheet 1 that has been cut by the slitter 13 up to the rear edge position to be cut is in a state of having been conveyed in the conveyance direction up to a position beyond the cutting position of the cutter unit 300, the roll sheet 1 is reversely conveyed up to the scanning position of the cutter unit 300.

In S608, the control unit 400 reversely conveys the roll sheet 1, which has been cut by the slitter units 303 up to the rear edge position to be cut, up to the scanning position (cutting position) of the cutter unit 300. That is, the roll sheet 1 is reversely conveyed such that the rear edge position to be cut is positioned on the scanning line of the cutter unit 300.

Figure 13:
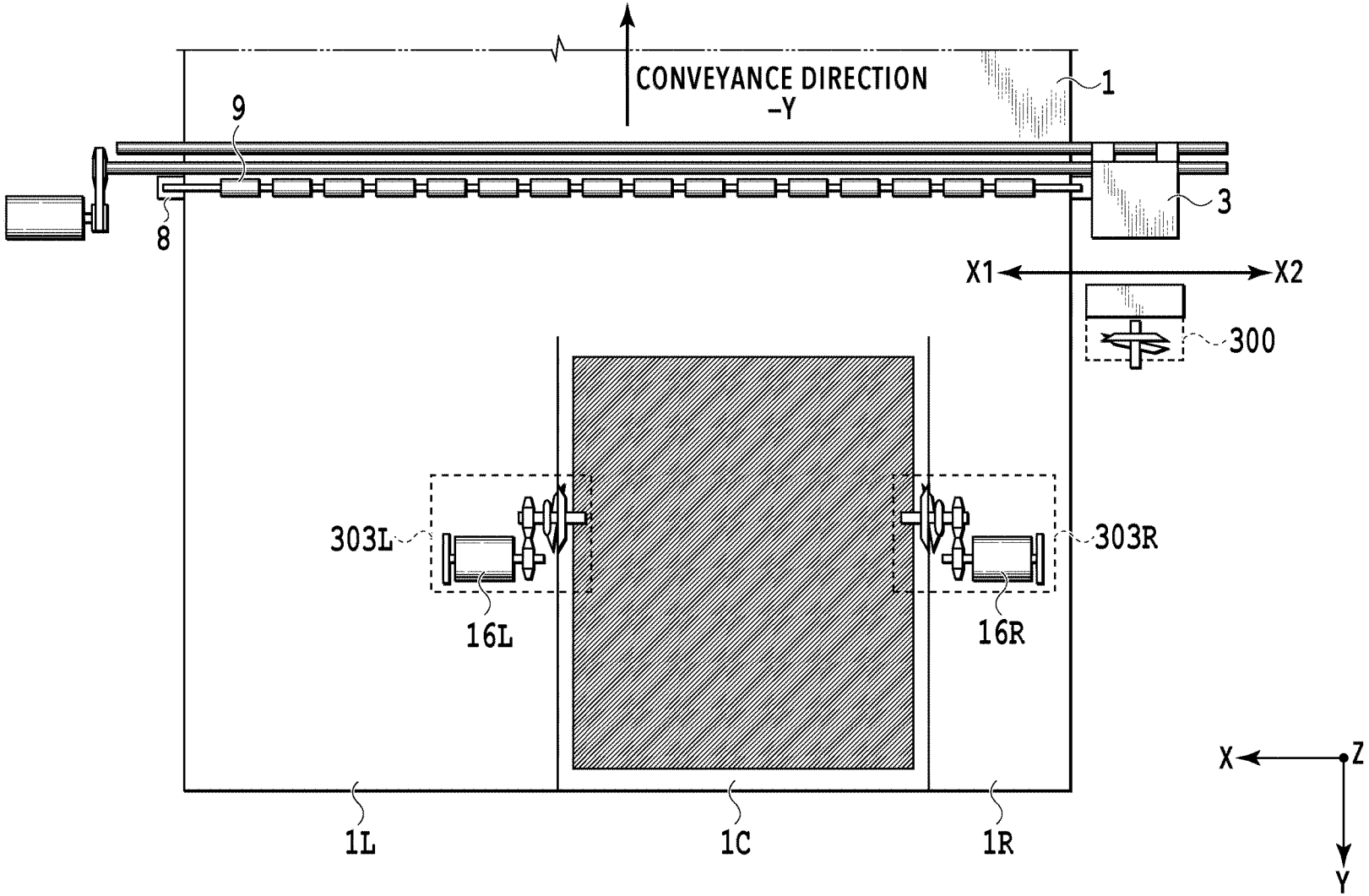
FIG. 13 is a conceptual diagram of operation of the printing apparatus.

FIG. 13 illustrates a state in which the roll sheet 1 has been reversely conveyed such that the rear edge position to be cut is positioned on the scanning line of the cutter unit 300. Then, the control unit 400 cuts the roll sheet 1 by use of the cutter unit 300 in an intersecting direction, which is orthogonal to the conveyance direction. That is, the control unit 400 drives the cutter motor 103 to cut the roll sheet 1 in the intersecting direction by use of the cutter unit 300.

Figure 14:
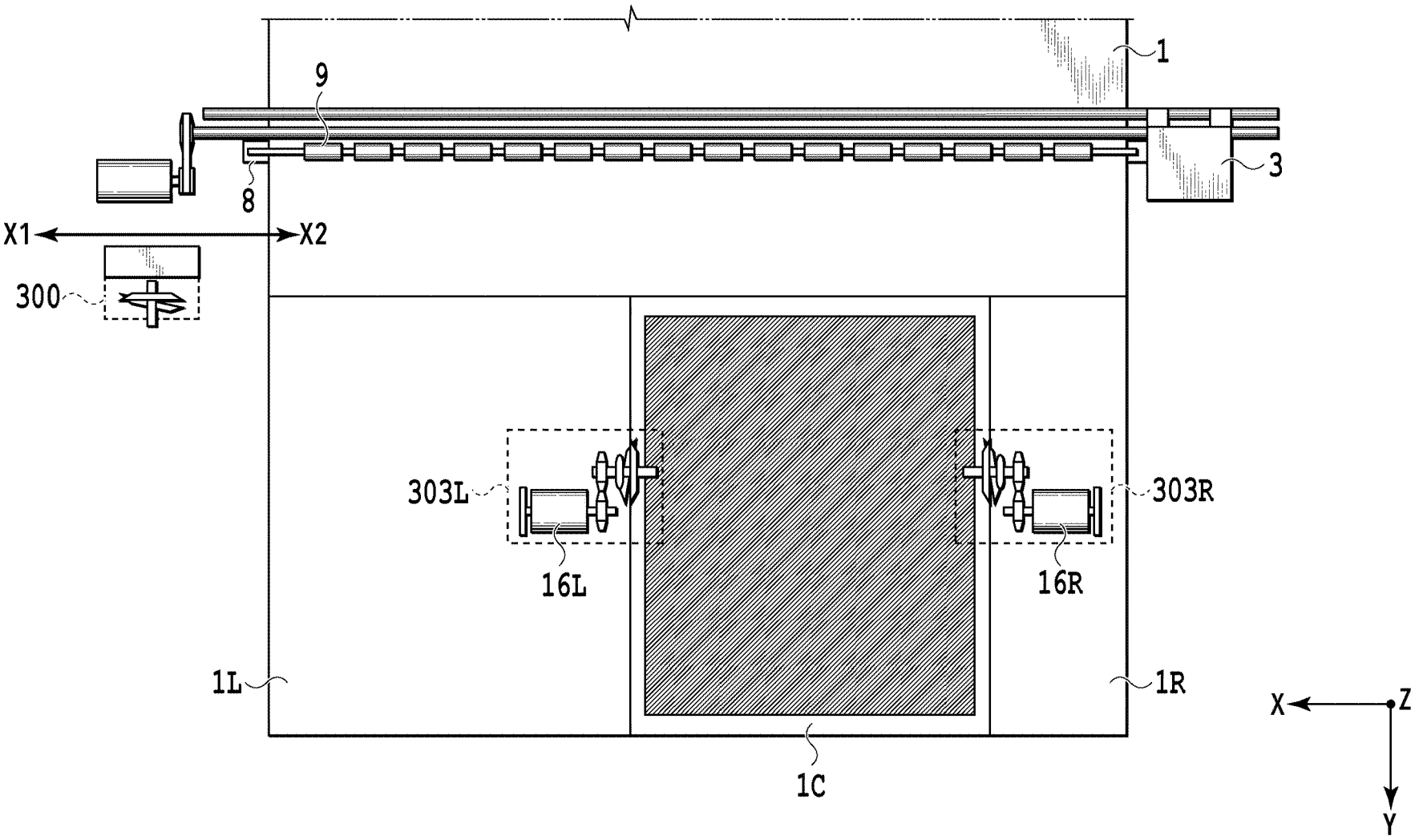
FIG. 14 is a conceptual diagram of operation of the printing apparatus.
Figure 15:
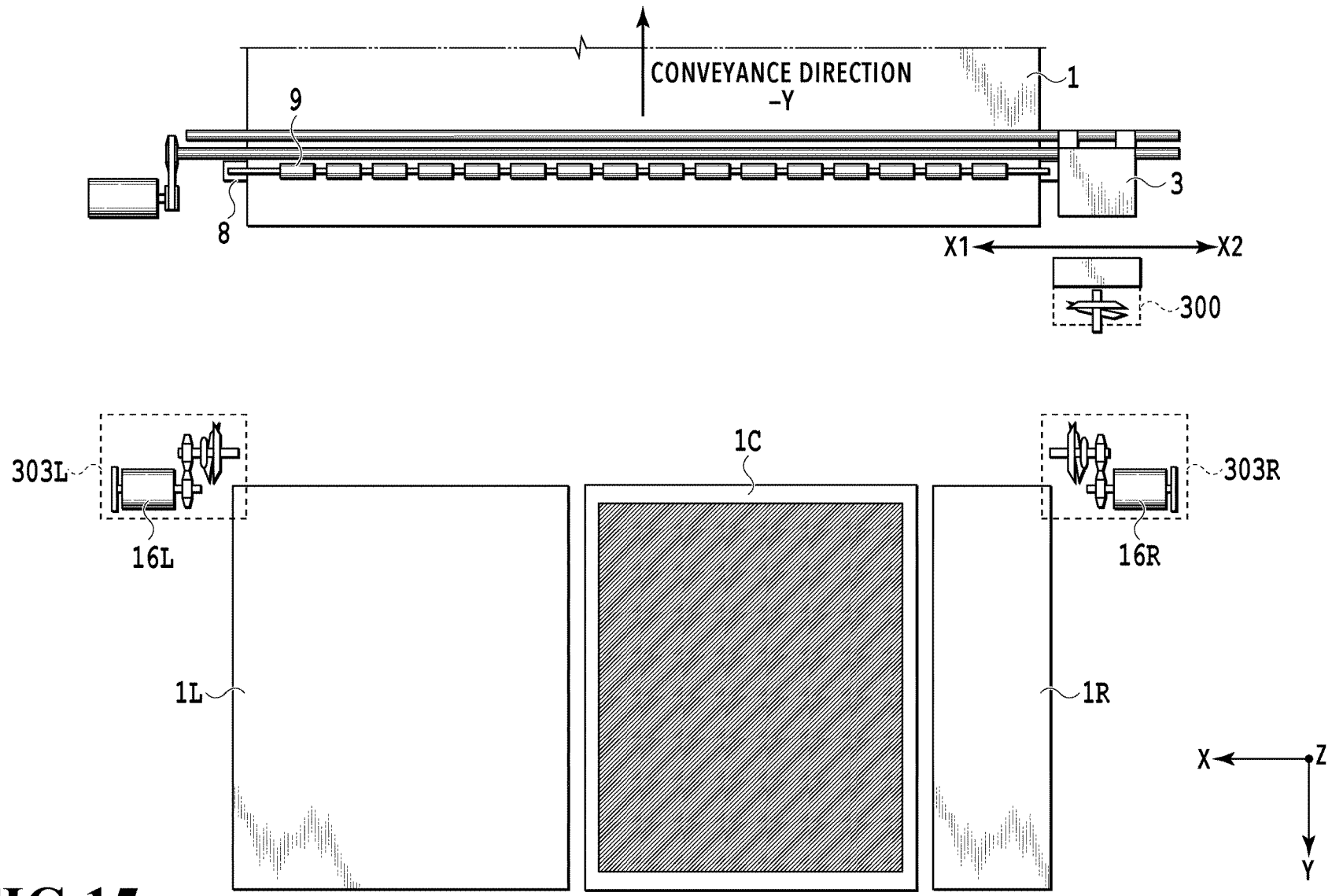
FIG. 15 is a conceptual diagram of operation of the printing apparatus.

FIG. 14 is a diagram illustrating a situation in which the roll sheet 1, which has been conveyed such that the rear edge position to be cut is positioned on the scanning line of the cutter unit 300, has been cut by the cutter unit 300. The printed subject 1C and the cut pieces 1R and 1L that have been cut are discharged by their own weight in S609. The control unit 400 reversely conveys the roll sheet 1 to prepare for the next printing. FIG. 15 is a diagram illustrating a situation in which the printed subject 1C and the cut pieces 1R and 1L have been discharged and the roll sheet 1 has been rewound.

Here, the explanation has been given with the example in which the rear edge position to be cut by the slitter units 303R and 303L in the conveyance direction of the roll sheet 1 is conveyed so as to be positioned on the scanning line of the cutter unit 300. Furthermore, in the explanation of the example, the cutting by the cutter unit 300 is performed once. Here, the cutting by the cutter unit 300 may be performed twice. For example, the cutting by the slitter units 303R and 303L in S603 may be performed up to a position beyond the rear edge position to be cut, which corresponds to the rear edge of the printed subject 1C, by a predetermined length. Then, after the printing of the image, the roll sheet 1 that has been conveyed such that the rear edge position to be cut, which corresponds to the rear edge of the printed subject 1C, is positioned on the scanning line of the cutter unit 300 may be cut by the cutter unit 300 in S608. Subsequently, the roll sheet 1 may be further conveyed by an amount corresponding to the predetermined length and cut again by the cutter unit 300.

In the present embodiment, the printing start position of an image is determined with reference to the leading edge of the roll sheet 1. That is, printing of an image is started from the leading edge of the roll sheet 1. In the example illustrated in FIG. 10, etc., it is illustrated that the image includes a margin, and the actual image is printed behind the length of the margin. In a case where an image does not include a margin, the actual image is printed from the leading edge of the roll sheet 1 on which cuts have been made at the leading edge portions.

Here, for another example, the printing start position of an image may be set as a position changeable according to the leading edge portion of the roll sheet 1 on which a cut has been made. For example, some users may desire not to print an image at a position where a cut has been made. Thus, there may be a configuration in which whether the printing start position of an image is set as a position changeable according to the leading edge portion of the roll sheet 1 on which a cut has been made or not can be switched according to a setting by a user. In a case where the printing start position of an image is set as a position changeable according to the leading edge portion of the roll sheet 1 on which a cut has been made, the printing start position of the image is determined with reference to the rear edge of the cut area at the leading edge portion. That is, on the roll sheet 1, the printing start position of the image is set as a position on the upstream side relative to the rear edge of the cut area in the conveyance direction. In this case, the cut area at the leading edge portion of the roll sheet 1 is a region where the image is not printed, and therefore the cut area at the leading edge portion of the roll sheet 1 is to be cut by the cutter 5. That is, the cutter 5 cuts the roll sheet 1 in the intersecting direction at the rear edge position of the cut area at the leading edge portion of the roll sheet 1. Thereafter, the cutter 5 cuts the roll sheet 1 in the intersecting direction at the rear edge position of the roll sheet 1 to be cut. That is, in S608, the control unit 400 performs the first cutting operation in which the roll sheet 1 is reversely conveyed until the rear edge positions of the cut areas reach the scanning position of the cutter unit 300 and the roll sheet 1 is cut by scanning of the cutter unit 300. Thereafter, the control unit 400 performs the second cutting operation in which the roll sheet 1 is conveyed until the rear edge position of the roll sheet 1 to be cut reaches the scanning line of the cutter unit 300 and the roll sheet 1 is cut by scanning of the cutter unit 300. As described above, cutting operation by the cutter 5 may be performed twice.

As explained above, in the present embodiment, in a case where processing based on a print job is performed, the leading edge portions of the roll sheet 1 are cut by the slitter units 303 in the direction parallel to the conveyance direction prior to printing operation by the print head 2. Then, the printing operation and the cutting operation in the conveyance direction are performed on the roll sheet 1 on which the cuts have been made at the leading edge portions. Since the cuts have already been made in the above-described manner, it is possible for the leading edge of the roll sheet 1 to smoothly enter the slitter units 303 at the timing where the leading edge of the roll sheet 1 re-enters the slitter units 303. That is, at the timing where the leading edge of the roll sheet 1 re-enters the slitter units 303, the leading edge portions of the roll sheet 1 are properly fed into the slitter upper movable blades 304 and the slitter lower movable blades 305 of the slitter units 303. For this reason, it is possible to prevent the roll sheet 1 from buckling at a timing where the roll sheet 1 enters a slitter unit 303.

In the present embodiment, it should be noted that the conveyance by the conveyance motor 51 is performed at regular intervals from S605 to S607. In a case where an image is printed by ejection of ink by use of the print head 2 as in the present embodiment, scanning and printing operation by the print head 2 and conveyance of the roll sheet 1 are alternately repeated at predetermined intervals in consideration of the time period for ink to permeate into the printing medium. In other words, in a case where the conveyance speed of the roll sheet 1 is partially changed, there is a possibility of unevenness of the printed image. For example, below is consideration of a mode in which the conveyance speed at the timing where a leading edge portion of the roll sheet 1 enters a slitter unit 303 is changed so as to prevent the roll sheet 1 from buckling. In this case, the timing where a leading edge portion of the roll sheet 1 enters a slitter unit 303 as illustrated in FIG. 10 is during printing of an image on the roll sheet 1. Here, in a case where the conveyance speed of the roll sheet 1 is changed, there is a possibility of unevenness of the printed image.

In the present embodiment, the cuts are made at the leading edge portions of the roll sheet 1 in advance, and then the roll sheet 1 is controlled to re-enter the slitter units 303 while an image being printed. The conveyance speed does not change between the timing of re-entry and the other timings of image printing. Accordingly, it is possible to prevent unevenness of the printed image from occurring.

The conveyance speed of the roll sheet 1 from S602 to S603 may be different from the conveyance speed of the roll sheet 1 from S605 to S607. This is because printing of the image is not performed in the control of S602 to S603. Therefore, the conveyance speed of the roll sheet 1 from S602 to S603 may be controlled to be a speed that is suitable for cutting the leading edge portions of the roll sheet 1. For example, the conveyance speed at the timing of making the cuts at the leading edge portions of the roll sheet 1 may be controlled to be temporarily faster than the conveyance speed of S605 to S607. Alternatively, the rotation speed of the slitter driving motors 16 may be controlled to be faster.

Other Embodiments

In the above-described embodiment, the explanation is given with the example of a printing apparatus in which the carriage 3 scans in the X direction while holding the print head 2, so as to perform printing operation. However, there may be a mode in which a print head that is provided with ejection openings corresponding to the size of a printing medium in the width direction, which may be termed as a line-type print head, is used.

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-066225, filed Mar. 29, 2019, which is hereby incorporated by reference wherein herein in its entirety.

What is claimed is:

1. A printing apparatus comprising:

a conveyance unit configured to convey a printing medium in a conveyance direction;

a print unit configured to print an image on the printing medium conveyed by the conveyance unit; and a slitter disposed on a downstream side relative to the print unit in the conveyance direction and configured to cut the printing medium in the conveyance direction in accordance with the conveyance by the conveyance unit, wherein the slitter is configured to cut a leading edge portion of the printing medium in accordance with the conveyance of the printing medium by the conveyance unit, wherein, after the leading edge portion of the printing medium is cut by the slitter, the conveyance unit is configured to convey the printing medium in an opposite direction of the conveyance direction up to a printing start position, and wherein the printing medium of which the leading edge portion has been cut and on which the image has been printed is conveyed by the conveyance unit in the conveyance direction, so that the slitter further cuts a portion extending from the leading edge portion of the printing medium in the conveyance direction.

2. The printing apparatus according to claim 1, wherein the leading edge portion of the printing medium corresponds to a portion extending from a leading edge of the printing medium in the conveyance direction by a length determined according to the slitter.

3. The printing apparatus according to claim 2, wherein the slitter includes a round blade, and wherein the length corresponds to a radius of the round blade.

4. The printing apparatus according to claim 1, wherein the printing of the image by the print unit and the cutting of the portion extending from the leading edge portion by the slitter are performed concurrently with each other.

5. The printing apparatus according to claim 1, wherein the printing of the image by the print unit ends prior to the cutting of the portion extending from the leading edge portion by the slitter.

6. The printing apparatus according to claim 1, wherein, after the printing of the image by the print unit ends, the conveyance unit is configured to convey the printing medium in the conveyance direction, so that the cutting of the printing medium by the slitter is performed up to a rear edge position to be cut.

7. The printing apparatus according to claim 6, further comprising a cutter disposed (a) on a downstream side relative to the print unit in the conveyance direction and (b) on an upstream side relative to the slitter in the conveyance direction, the cutter being configured to cut the printing medium in an intersecting direction, which intersects the conveyance direction, wherein the cutter is configured to cut the printing medium, on which the printing has been completed and which has been cut in the conveyance direction up to the rear edge position to be cut.

8. The printing apparatus according to claim 7, wherein the conveyance unit is configured to convey the printing medium, on which the printing has been completed and which has been cut in the conveyance direction up to the rear edge position to be cut, in the opposite direction of the conveyance direction.

9. The printing apparatus according to claim 7, wherein the cutter is configured to cut the printing medium in the intersecting direction at the rear edge position to be cut.

10. The printing apparatus according to claim 7, wherein the cutter is configured to cut the printing medium in the intersecting direction at the rear edge position to be cut, after cutting the printing medium in the intersecting direction at a rear edge position of the leading edge portion.

11. The printing apparatus according to claim 1, wherein the conveyance unit is configured to change a conveyance speed between (a) a timing where the leading edge portion of the printing medium is cut and (b) a timing where the portion extending from the leading edge portion is cut.

12. The printing apparatus according to claim 1, wherein the print unit comprises a print head.

13. A control method of a printing apparatus including (a) a conveyance unit configured to convey a printing medium in a conveyance direction, (b) a print unit configured to print an image on the printing medium conveyed by the conveyance unit, and (c) a slitter disposed on a downstream side relative to the print unit in the conveyance direction and configured to cut the printing medium in the conveyance direction in accordance with the conveyance by the conveyance unit, the control method comprising:

cutting a leading edge portion of the printing medium by the slitter in accordance with the conveyance of the printing medium by the conveyance unit;

conveying the printing medium, of which the leading portion has been cut, by the conveyance unit in an opposite direction of the conveyance direction up to a printing start position after the cutting; and conveying, by the conveyance unit in the conveyance direction, the printing medium of which the leading edge portion has been cut and on which the image has been printed, so that the slitter further cuts a portion extending from the leading edge portion of the printing medium in the conveyance direction.

14. A sheet conveyance apparatus comprising:

a conveyance unit configured to convey a printing medium in a conveyance direction; and a slitter disposed on a downstream side relative to the conveyance unit in the conveyance direction and configured to cut the printing medium in the conveyance direction in accordance with the conveyance by the conveyance unit, wherein the slitter is configured to cut a leading edge portion of the printing medium in accordance with the conveyance of the printing medium by the conveyance unit, wherein, after the leading edge portion of the printing medium is cut by the slitter, the conveyance unit is configured to convey the printing medium in an opposite direction of the conveyance direction up to a printing start position, and wherein the printing medium of which the leading edge portion has been cut is conveyed by the conveyance unit in the conveyance direction, so that the slitter further cuts a portion extending from the leading edge portion of the printing medium in the conveyance direction.

15. The sheet conveyance apparatus according to claim 14, wherein the leading edge portion of the printing medium corresponds to a portion extending from a leading edge of the printing medium in the conveyance direction by a length determined according to the slitter.

16. The sheet conveyance apparatus according to claim 15, wherein the slitter includes a round blade, and wherein the length corresponds to a radius of the round blade.

17. The sheet conveyance apparatus according to claim 14, further comprising a cutter disposed (a) on a downstream side relative to the conveyance unit in the conveyance direction and (b) on an upstream side relative to the slitter in the conveyance direction, the cutter being configured to cut the printing medium in an intersecting direction, which intersects the conveyance direction, wherein the cutter is configured to cut the printing medium, on which the printing has been completed and which has been cut in the conveyance direction up to the rear edge position to be cut.

18. The sheet conveyance apparatus according to claim 17, wherein the cutter is configured to cut the printing medium in the intersecting direction at the rear edge position to be cut.

19. The sheet conveyance apparatus according to claim 17, wherein the cutter is configured to cut the printing medium in the intersecting direction at the rear edge position to be cut, after cutting the printing medium in the intersecting direction at a rear edge position of the leading edge portion.

20. The sheet conveyance apparatus according to claim 14, wherein the conveyance unit is configured to change a conveyance speed between (a) a timing where the leading edge portion of the printing medium is cut and (b) a timing where the portion extending from the leading edge portion is cut.

* * * * *